US005776285A

United States Patent [19]

Blümle

[11] Patent Number: 5,776,285

[45] Date of Patent: Jul. 7, 1998

[54] METHOD AND APPARATUS FOR APPLYING ADHESIVE TO A CLOSURE FLAP OF ENVELOPES

[75] Inventor: Martin Blümle, Horhausen, Germany

[73] Assignee: Winkler & Duennebier Maschinenfabrik und Eisengiesserei KG., Neuwied, Germany

[21] Appl. No.: 596,697

[22] Filed: Feb. 5, 1996

Related U.S. Application Data

[63] Continuation of Ser. No. 237,115, May 3, 1994, abandoned.

[30] Foreign Application Priority Data

May 4, 1993 [DE] Germany ..... 43 14 685.6

[51] Int. Cl.[6] ..... B32B 31/10; B32B 31/12; B32B 35/00

[52] U.S. Cl. ..... 156/256; 156/289; 156/518; 156/521; 156/533; 156/534; 156/539; 156/555; 156/578; 229/900; 493/210; 493/220

[58] Field of Search ..... 156/256, 264, 156/265, 278, 289, 299, 441.5, 518, 521, 538, 539, 555, 530, 578, 533, 534; 53/460; 229/76, 80, 80.5, 800, 900; 118/211, 212, 216, 224, 241, 247, 248, 261; 427/256, 289, 208.4; 493/212, 210, 213, 220, 917, 923, 963

[56] References Cited

U.S. PATENT DOCUMENTS

| | | | |
|---|---|---|---|
| 2,231,051 | 2/1941 | Bischoff . | |
| 2,494,176 | 1/1950 | Howard | 118/247 X |
| 2,946,370 | 7/1960 | Muttera, Jr. | 156/578 X |
| 2,962,205 | 11/1960 | McFarland | 229/80 |
| 2,990,081 | 6/1961 | De Neui et al. | 156/521 X |
| 3,300,363 | 1/1967 | Burroughs . | |
| 3,372,861 | 3/1968 | Johnson et al. . | |
| 3,408,908 | 11/1968 | Berkowitz | 156/521 X |
| 3,445,314 | 5/1969 | Crim . | |
| 3,560,310 | 2/1971 | Bolton | 156/578 X |
| 3,582,437 | 6/1971 | Lenk | 156/521 |
| 3,654,038 | 4/1972 | Hottendorf | 156/521 |
| 3,674,595 | 7/1972 | Roeder . | |
| 3,675,844 | 7/1972 | Sorrell | 156/313 X |
| 3,688,771 | 9/1972 | Werner | 156/289 X |
| 3,745,893 | 7/1973 | Helm et al. | 156/521 X |
| 3,868,894 | 3/1975 | Watson . | |
| 3,906,884 | 9/1975 | Gougeon . | |
| 3,991,708 | 11/1976 | Huebschmann et al. | 118/247 X |
| 4,003,780 | 1/1977 | Cohn | 156/355 X |
| 4,020,194 | 4/1977 | McIntyre et al. | 118/247 X |

(List continued on next page.)

FOREIGN PATENT DOCUMENTS 2195938 4/1974 France .

*Primary Examiner*—Curtis Mayes
*Attorney, Agent, or Firm*—W. G. Fasse; W. F. Fasse

[57] ABSTRACT

Adhesive, preferably pressure sensitive adhesive, is applied to an article of manufacture, such as the closure flap of an envelope or paper bag in such a way that the adhesive is protected against activation prior to closing the article. For this purpose, the adhesive is first applied to a continuous web or tape of a carrier material that either has an inherent anti-stick characteristic or is provided with an anti-stick surface coating relative to the adhesive to be applied. Preferably, the adhesive does not cover the entire surface of the carrier strip, but rather covers only areas in the form of stripes extending at least partly across the width of the carrier web. The adhesive stripes are spaced from one another and preferably also from at least one edge of the carrier web or tape. The carrier web is then severed into strips, each provided with one adhesive stripe and these strips with the adhesive stripes thereon are then secured between two rollers to the surface area to be provided with the adhesive. The web material forms a substrate or backing for each individual adhesive stripe. The backing is then removed when the article is to be closed. The apparatus for this purpose is provided with a feed advance for the tape or web, with an adhesive applicator and with a cutter that preferably also functions as a strip applicator.

16 Claims, 6 Drawing Sheets

U.S. PATENT DOCUMENTS

| | | | |
|---|---|---|---|
| 4,183,978 | 1/1980 | Hefele . | |
| 4,339,481 | 7/1982 | Beekhuis | 118/249 X |
| 4,510,621 | 4/1985 | Sak et al. | 229/80 X |
| 4,594,962 | 6/1986 | Focke | 118/221 |
| 4,642,085 | 2/1987 | Helm | 156/519 X |
| 4,675,069 | 6/1987 | Matte et al. | 156/510 |
| 4,857,066 | 8/1989 | Allison | 229/80 X |
| 5,176,611 | 1/1993 | VerMehren | 493/213 |
| 5,261,996 | 11/1993 | Rossini | 156/521 |
| 5,429,576 | 7/1995 | Doderer-Winkler | 156/521 X |

METHOD AND APPARATUS FOR APPLYING ADHESIVE TO A CLOSURE FLAP OF ENVELOPES

This application is a file wrapper continuation of application Ser. No. 08/237,115, filed on May 3, 1994, now abandoned.

FIELD OF THE INVENTION

The invention relates to a method for applying an adhesive, preferably a pressure sensitive adhesive to an article of manufacture made of paper and/or synthetic material or mixtures thereof in sheet or web form. Such articles of manufacture are primarily letter envelopes, paper bags, plastic bags, and the like. The applied adhesive is protected against premature bonding by a protective cover strip formed as a substrate or backing that is removed just prior to activating the adhesive. The invention also relates to an apparatus for performing the method.

BACKGROUND INFORMATION

It is known to provide the closure flaps of articles of manufacture such as letter envelopes, bags, and the like made of paper and/or synthetic materials or materials combining paper and synthetics, with a pressure sensitive adhesive already during the production of the article of manufacture. Activation of the pressure sensitive adhesive is prevented until the article is used by a cover strip that protects the pressure sensitive adhesive against premature activation so that the closure flap cannot stick to any surface in an undesired and uncontrollable manner. The cover strip is pulled off only when the closure flap is to be intentionally closed, and the pressure sensitive adhesive is then activated.

In connection with letter envelopes it is also known to apply the pressure sensitive adhesive directly to the closure flap or to a bottom flap, whereupon the applied adhesive is covered by the protective cover strip. However, this operation is conventionally subject to a substantial technical effort and expense.

OBJECTS OF THE INVENTION

In view of the above it is the aim of the invention to achieve the following objects singly or in combination:

- to simplify the method and the apparatus for applying an adhesive, especially a pressure sensitive adhesive to an article of manufacture together with its protective strip;
- to use initially the protective strip material as a carrier for the pressure sensitive adhesive;
- to construct the present apparatus in such a way that a carrier for the pressure sensitive adhesive and the articles of manufacture travel into cooperation with each other along a production conveyor line; and
- to avoid the need for an adhesive supply trough and an adhesive applicator roller directly in the article manufacturing line.

SUMMARY OF THE INVENTION

The method according to the invention is characterized by using a continuous sheet, tape or web having an anti-sticking surface as a starting material for forming a carrier for the adhesive, preferably a pressure sensitive adhesive. The carrier material either has a smooth anti-sticking surface that prevents the permanent sticking of the adhesive or pressure sensitive adhesive, or the carrier material is provided on one surface with a bond preventing anti-sticking layer. Next, the adhesive is applied to the bond preventing surface of the carrier material. Then, the so prepared carrier web or tape with the adhesive applied thereto either entirely on one surface or preferably on selected surface areas of one surface, is cut into strips that function as protective cover strips and as carriers for the adhesive. In the next and final step these strips are secured with the adhesive to a bond forming surface of the article of manufacture, whereby the adhesive is sandwiched between the protective cover strip and the bond forming surface of the article of manufacture, such as a closure flap of a letter envelope.

When the article is to be closed, the protective strip is peeled off and the closure flap, e.g. of a letter envelope, is pressed against a cooperating surface portion of the letter envelope, whereby the envelope is closed by activating the adhesive, e.g. by pressure, or by prior moistening, or by heat application.

The invention has the advantage that the carrier material for the pressure sensitive adhesive performs several functions. Carrying the adhesive facilitates a clean adhesive application outside the envelope manufacturing line. Further, the adhesive is protected against activation until the protection strip is removed, whereby storage of the articles is facilitated.

The sequence of manufacturing steps according to the invention is simple and can be performed by an apparatus that is substantially less involved than conventional adhesive applicator devices. Further, closing of an envelope, for example, merely requires removal of the protective strip, whereupon a proper seal is accomplished without any difficulties because, for example the pressure sensitive adhesive can become effective immediately upon removal of the strip. Moreover, the area to be covered with the pressure sensitive adhesive can now be precisely determined by the size of the cut protective cover strip.

The apparatus according to the invention is characterized by the combination of an adhesive applicator device with a carrier tape or web supply, a plurality of feed advance and guide rollers for the carrier web or tape, and with a cutter arranged downstream of the adhesive applicator device as viewed in the moving direction of the web or tape. According to the invention, the cutter is constructed to simultaneously function as a strip applicator for securing cut strips to an article of manufacture.

In one embodiment the adhesive applicator device comprises an adhesive supply trough cooperating with an adhesive applicator roller and a doctor blade which returns excessive adhesive back into the supply trough. In another embodiment the adhesive applicator device comprises an intermittently operating adhesive spray nozzle arranged upstream of the cutter that preferably also functions as a strip applicator for securing a cut strip with its adhesive to an article of manufacture.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
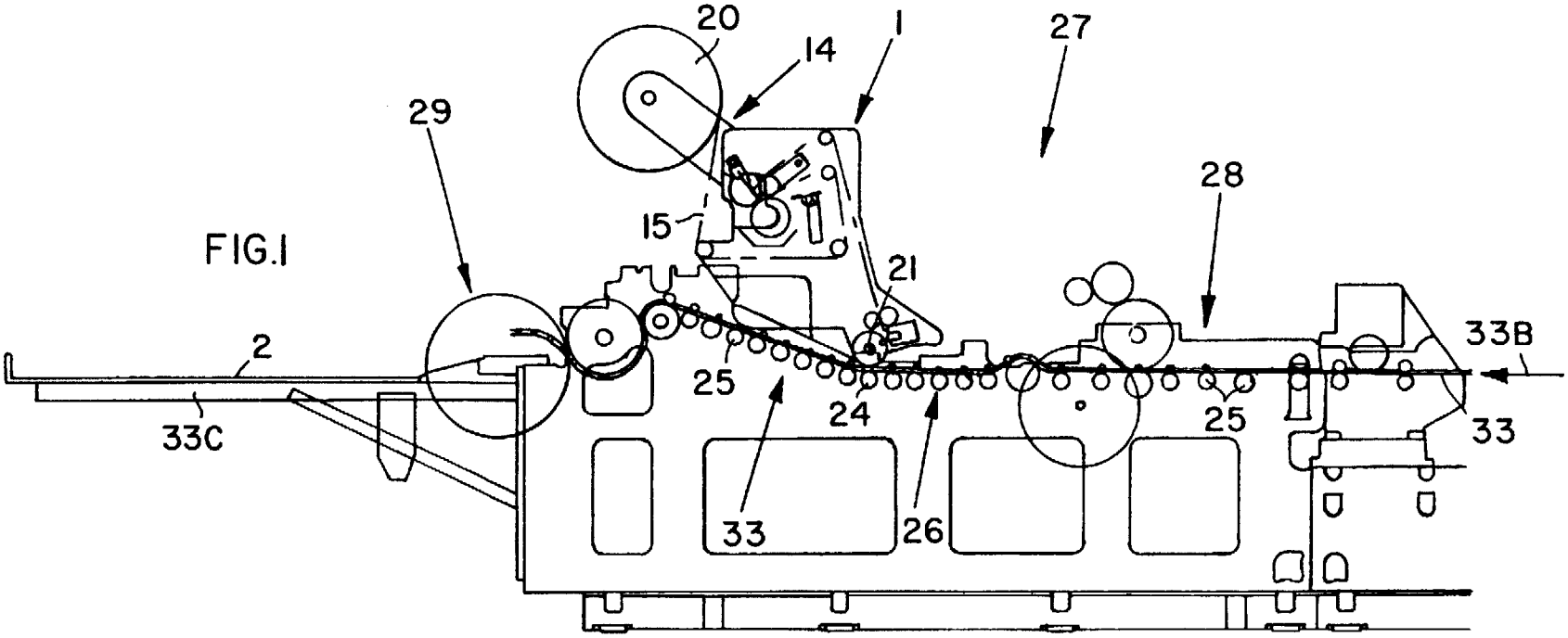
FIG. 1 is a schematic side view of a first embodiment of an apparatus of the invention for producing adhesive carrying strips and for securing these strips to an article of manufacture.
Figure 2:
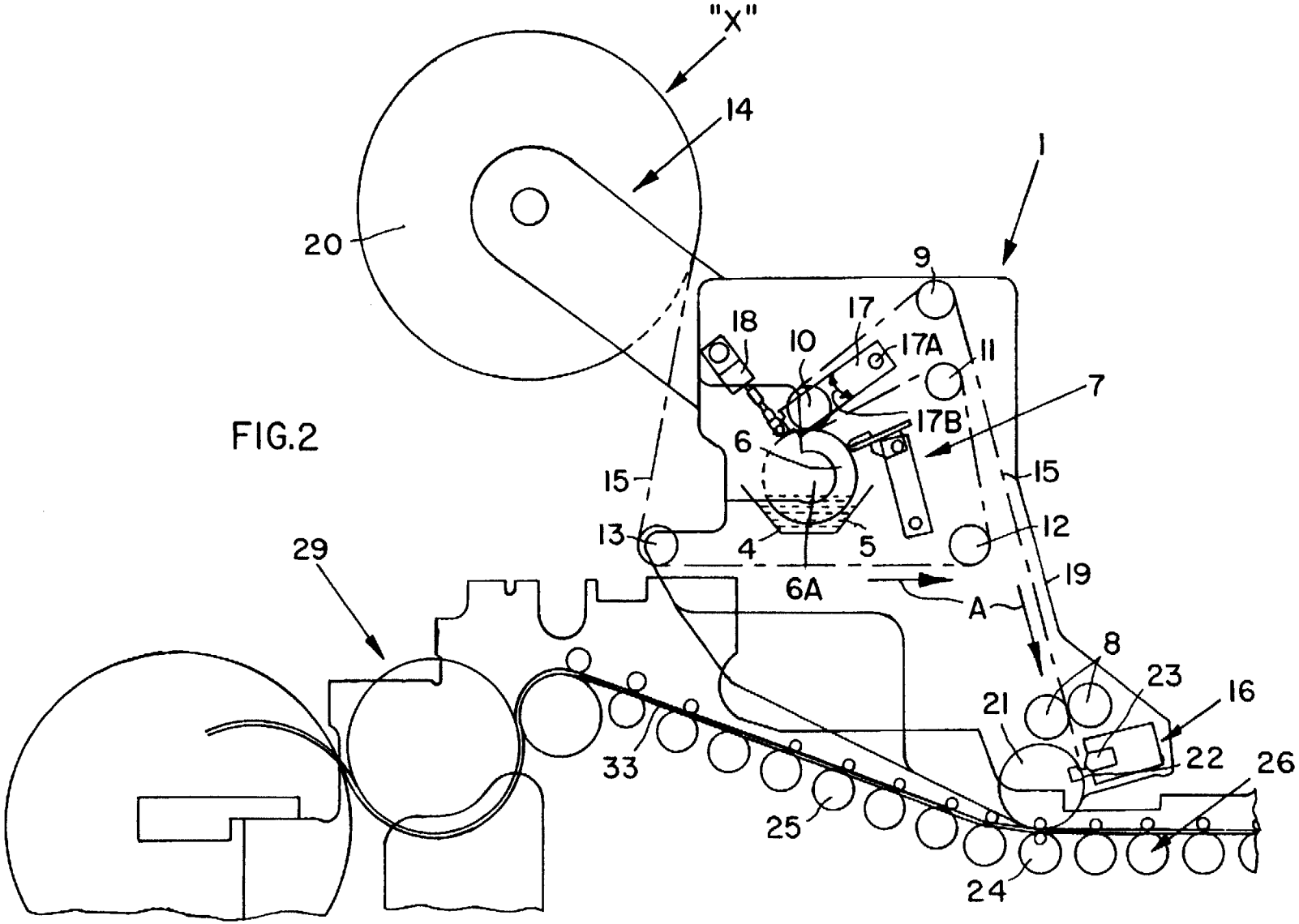
FIG. 2 is a view similar to that of FIG. 1, showing, on an enlarged scale, a first embodiment of an adhesive applicator device and a cutter for severing the adhesive carrier material into strips and applying the cut strips to articles of manufacture.
Figure 3:
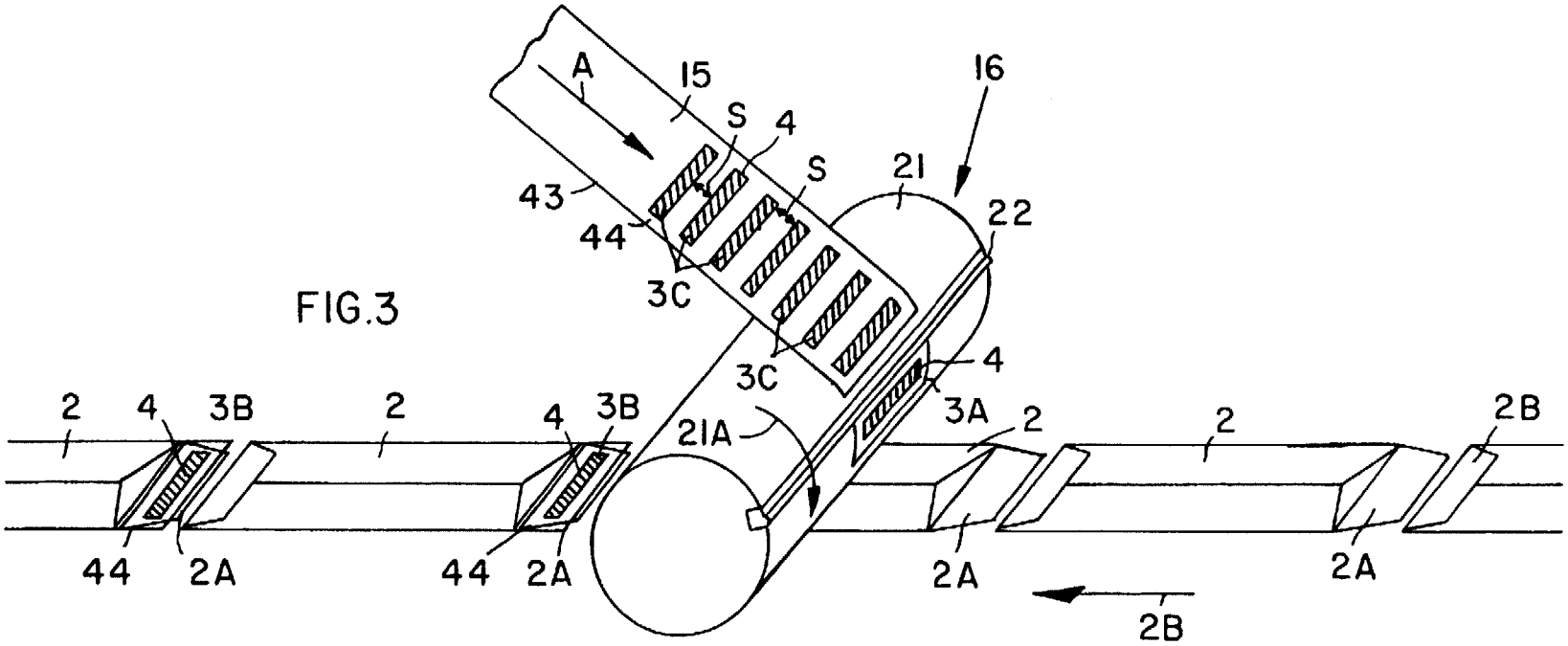
FIG. 3 shows a perspective view, on a further enlarged scale, of the cutter and strip applicator for securing cut strips to the closure flap of already severed letter envelopes travelling in a column.

FIGS. 1, 2 and 3 show an apparatus 1 for applying an adhesive 4 to an article 2 of manufacture. According to the invention, the adhesive 4 is first applied to a flat unfolded carrier web 15 that is then cut into protective strips 3A each provided with an adhesive stripe 3C. A cut strip 3A with its adhesive stripe 3C is then applied to the article 2 such as a letter envelope to form applied adhesive strips 3B as seen in FIG. 3. Preferably, the adhesive 4 is a pressure sensitive adhesive. As seen in FIG. 1, the articles 2 travel on a conveyor 33 in a feed advance direction indicated by an arrow 33B. The envelopes or articles 2 provided with the applied adhesive strip 3B are collected on a table 33C by a conventional article depositing device 29 forming part of the article manufacturing machine 27 having a first section 28 for forming the envelopes and an intermediate section 33A that rises in the feed advance direction 33B from right to left for cooperation with the apparatus 1 for the application of the adhesive strips 3A to the envelopes 2 to form applied adhesive strips 3B. The conveyor 33 comprises a plurality of transport rollers 25, 26 including a counter roller 24 that cooperates with a carrier web cutting roller 21 which also functions as a transfer roller for cut strips 3A. The roller 21 forms part of the apparatus 1 that produces the adhesive stripes 3C on the carrier web 15 by applying adhesive 4 to the carrier web or tape 15 taken off a supply roller 20 mounted on a carrier web roll-off mechanism 14 secured to a housing or machine frame 19 of the apparatus 1. Rollers 26 form a substantially horizontal section of the conveyor 33 upstream of the counter roller 24 as viewed in the feed advance direction 33B of the conveyor 33. Rollers 25 rise from right to left for accommodating the apparatus 1. The rollers 25 are arranged downstream of the counter roller 24. All rollers 24, 25, 26 of the conveyor 33 rotate in the same direction to assure the feed advance in the direction 33B.

Referring to FIG. 2, the first embodiment of the invention includes in the apparatus 1, a trough 5 holding adhesive 4 carried by an applicator roller 6 into contact with the adhesive carrier web or tape 15 that travels over guide and advance rollers 9, 10, 11, 12 and 13 mounted in the housing or machine frame 19 of the apparatus 1. The roller 6 is mounted for rotation on a bracket 6A of the frame 19. The roller 6 dips into the adhesive 4 in the trough 5. A doctor blade mechanism 7 removes excessive adhesive from the surface of the applicator roller 6. The blade 7 and the trough 5 may form an integral structure. The carrier web 15 travels in the direction of the arrow A through the apparatus 1 from the supply roller 20 carried by the roll-off mechanism 14. Two pull and guide rollers 8 supply the leading end of the web 15 to a cutting and strip applicator 16 to be described in more detail below. At least one of the rollers 8 to 13 is preferably a driven roller. All rollers 8 to 13 are mounted for rotation in the machine frame 19 of the apparatus 1 and cooperate with the web roll-off mechanism 14.

The cutter 16 comprises a strip cutting and strip applicator roller 21 which is also an applicator or strip transfer roller 21 mounted to the machine frame 19 for cutting adhesive carrying strips 3A from the web 15 and transferring and applying these strips 3A to the envelopes 2 travelling on the counter-roller 24. The two rollers 8 are auxiliary pulling rollers and therefore they are preferably positively driven. These rollers 8 are arranged directly upstream of the cutter and applicator 16 as viewed in the travel direction A of the web 15. The rollers 9, 11, 12 and 13 are primarily guide rollers. The roller 10 functions as a counter-roller and simultaneously as a main feed advance roller so that the roller 10 is positively driven. The roller 10 is rotatably mounted to the free end of brackets 17 tiltably mounted by a journal axis 17A to the machine frame 19 and operated by a piston cylinder device 18 having a piston rod connected with its free end to the free end of the brackets 17 for tilting the brackets and thus the counter-pressure roller 10 about the journal axis 17A as indicated by the double arrow 17B. When the piston rod of the piston cylinder device 18 is extended, the roller 10 is pressed against the roller 6. When the piston rod is withdrawn the roller 10 is tilted away from the roller 6 and pressure is released. If the roller 10 is the feed advance or drive roller, the transport of the web 15 can be interrupted by lifting the roller 10 off the roller 6.

The carrier web 15 is pulled off from the supply roller 20. The web 15 first travels downwardly over a guide roller 13 and then horizontally to the guide roller 12 and then substantially vertically upwardly over the guide roller 11 to the drive roller 10, whereby the web or tape 15 approximately encircles the trough 5 and adhesive applicator roller 6. From the roller 10 the tape now provided with adhesive stripes 3C travels over the guide roller 9 to the pull and guide rollers 8. The roller 10 also functions as a detouring roller for the tape 15 as best seen in FIG. 2.

Figure 5:
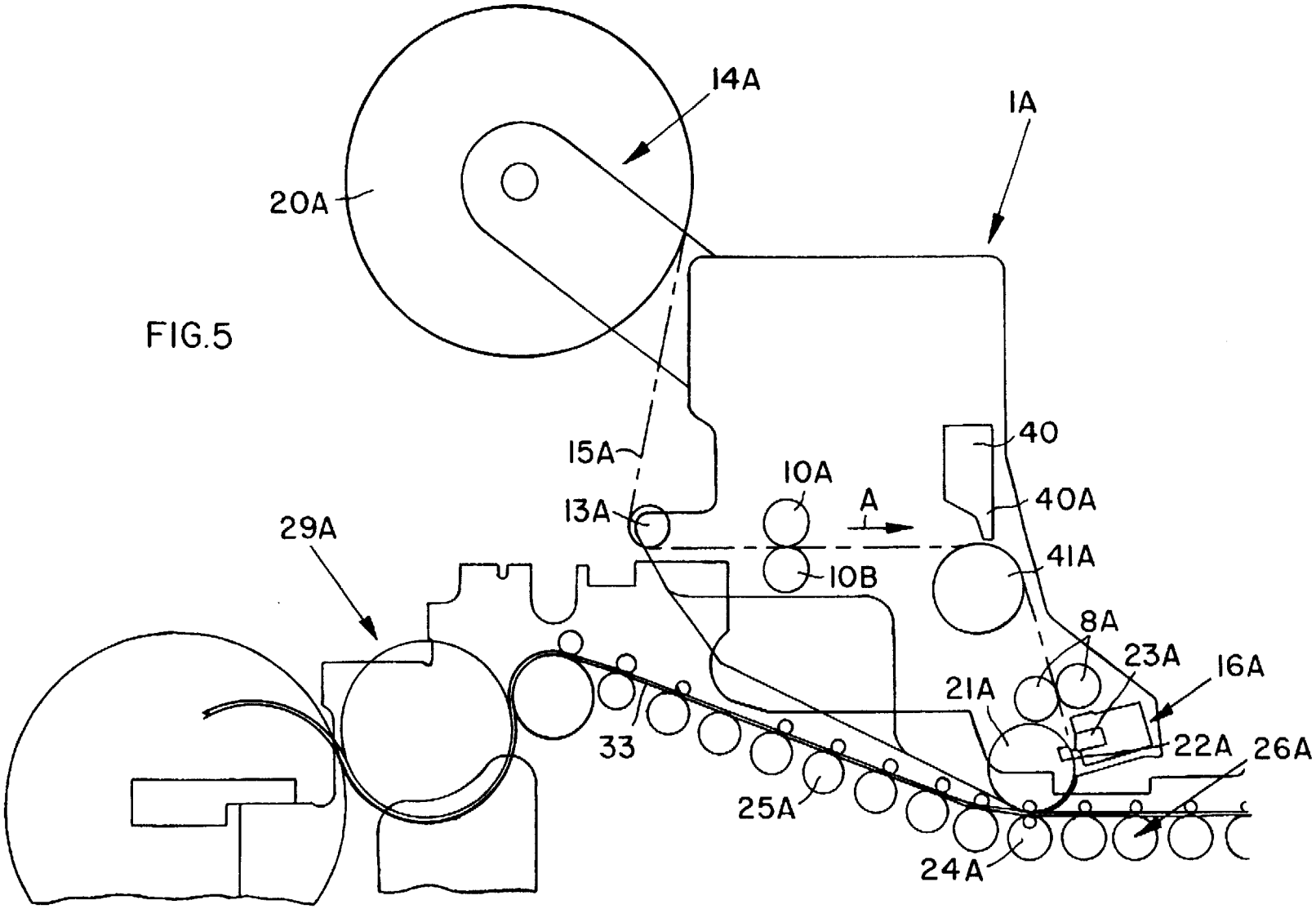
FIG. 5 is a side view of a modified adhesive device and a cutter of the invention, whereby the adhesive is applied by an adhesive spray nozzle.

The above mentioned cutter roller 21 of the cutter and strip applicator 16 carries at least one cutting knife 22 shown in FIG. 3 and cooperates with a counter edge 23 mounted in the machine frame 19 as seen in FIG. 2. The cutter roller 21 also functions as a strip applicator roller. For this purpose the rollers 21 is provided with valve controlled suction holes for carrying a strip 3A provided with an adhesive stripe 3C to an envelope 2 on the counter roller 24. The counter edge 23 in FIG. 2 or a similar counter edge 23A in FIG. 5 is so positioned that cutting of strips 3A takes place where there is no adhesive, namely in the spacing S described in more detail below.

Referring to FIGS. 2 and 3, the cutting roller 21 severs the leading strip 3A covered with adhesive 4 in the form of a stripe 3C from the forward end of the web 15. The suction through the above mentioned suction holes in the surface of the cutting roller 21 keeps holding the severed leading strip 3A on the surface of the roller that rotates clockwise in FIG. 3 as illustrated by the arrow 21A for applying the severed strip 3A to the upwardly facing surface 2A of a closure flap of an envelope 2 travelling in the direction of the arrow 2B past the rollers 21, 24 which cooperate in applying the severed strip 3A to the closure flap 2A. The applied strip 3B is shown to the left of the roller 21 in FIG. 3, whereby the adhesive 4 is sandwiched between the surface 2A of the closure flap and the backing or substrate formed by the strip 3A cut off from the web 15.

In the preferred embodiment, the adhesive 4 is applied in the form of stripes 3C to the strips 3A so that a margin 44 free of adhesive is provided at least along one longitudinal edge 43 of the web 15 to facilitate peeling off the backing so that only the adhesive stripe 3C remains secured to the surface 2A of the closure flap which may later be closed by pressing the flap against the side wall of the envelope.

The counter-roller 24 is part of a plurality of the above mentioned transport rollers 25, 26 which form the conveyor 33 in the production machine 27. The above mentioned envelope depositing device 29 is arranged downstream of the apparatus 1 and downstream of the counter-roller 24 as viewed in the feed advance direction 2B of the envelopes 2 shown in FIG. 3.

The operation of the apparatus 1 will now be described. The carrier web 15 that forms the substrate for the individual strips 3A carrying adhesive 4 in the form of stripes 3C, has a width corresponding at least to the length of the adhesive stripe 3C. Preferably, the width of the tape 15 is somewhat wider than the length of the stripes 3C to provide the margin 44 without adhesive. Preferably, two such margins may be provided along each end of the adhesive stripes 3C. According to the invention the stripes 3C are spaced from one another by a spacing S in the longitudinal direction. The spacing S is free of adhesive whereby the knife 22 passing through the spacing S does not cut through adhesive. The spacing S free of adhesive also facilitates the removal of the backing or substrate when it is intended to close an envelope. The material of the carrier web 15 can be any suitable rip resistant material that either has an inherent anti-stick characteristic, such as a smooth surface, on which the adhesive 4 is applied, or which is provided with a coating of a parting agent. Such a parting agent may, for example be applied to the web or tape 15 as it is pulled-off the supply roller 20 as indicated by the arrow X in FIG. 2. Parting agents and their application to surfaces, for example by spraying, are well known.

In a preferred embodiment, the web 15 is a silicone paper which has an inherent anti-sticking characteristic for an adhesive that is conventionally used as a pressure-sensitive adhesive for closing envelopes or the like. However, any other conventional anti-sticking agent may be used.

Figure 6:
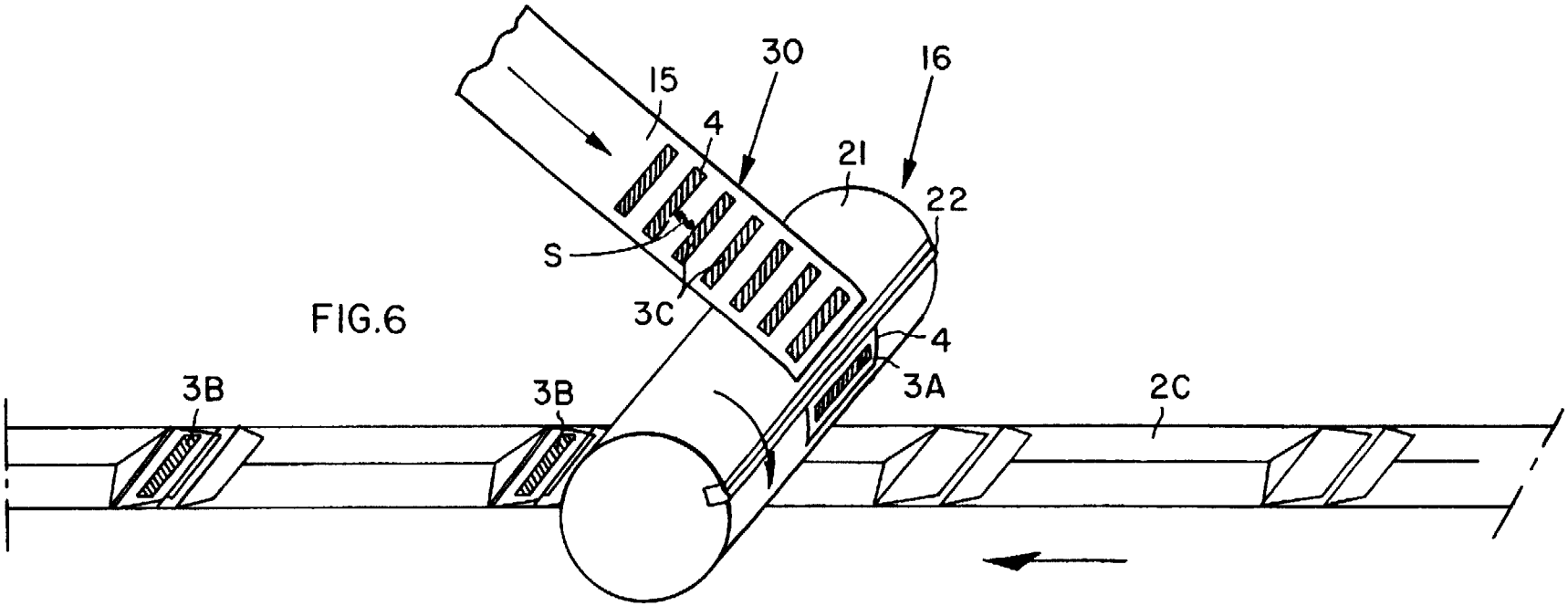
FIG. 6 is a view similar to that of FIG. 3, illustrating the application of strips carrying the adhesive, e.g. a pressure sensitive adhesive, to letter envelopes that have not yet been severed from each other so that the envelopes travel as a continuous belt.

As the web 15 travels past the applicator roller 6, the stripes 3C shown in FIG. 3 are applied by a pulsating pressure application. This pulsating pressure application is accomplished by the operation of the piston cylinder device 18 that repeatedly presses the roller 10 against the roller 6 in repetitious pressure application steps, when the pressure is released the spacings S are formed. The spacing S which is free of adhesive is also shown in FIG. 6.

As mentioned, the stripes 3C are preferably shorter than the width of the web 15 to form the adhesive-free margin 44. The length of the stripes 3C is determined by the length L of adhesive holding depressions 32 on the roller 6, please see FIG. 4. As the leading end of the web 15 with the adhesive stripes 3C secured thereto comes into the gap between the cutting roller 21 and the counter edge 23, a leading strip 3A is cut off so that the backing formed by the material of the web 15 faces upwardly and the adhesive 4 in the form of the stripe 3C faces the surface 2A of the envelope 2, please see FIG. 3. When the leading strip 3A is severed, vacuum holds the strip until it faces the surface 2A, whereupon the vacuum is shut off and the cooperation of the rollers 21 and 24 secure the adhesive to the surface 2A. Thus, the adhesive 4 is sandwiched between its backing or substrate and the surface 2A. In this operation the adhesive is not directly applied by a roller to the surface 2A of the envelope flap, but rather by the application of the leading strip 3A as described, whereby a substantially cleaner operation is assured and a prolonged storage of the articles even at higher than normal relative humidity is made possible.

Figure 4:
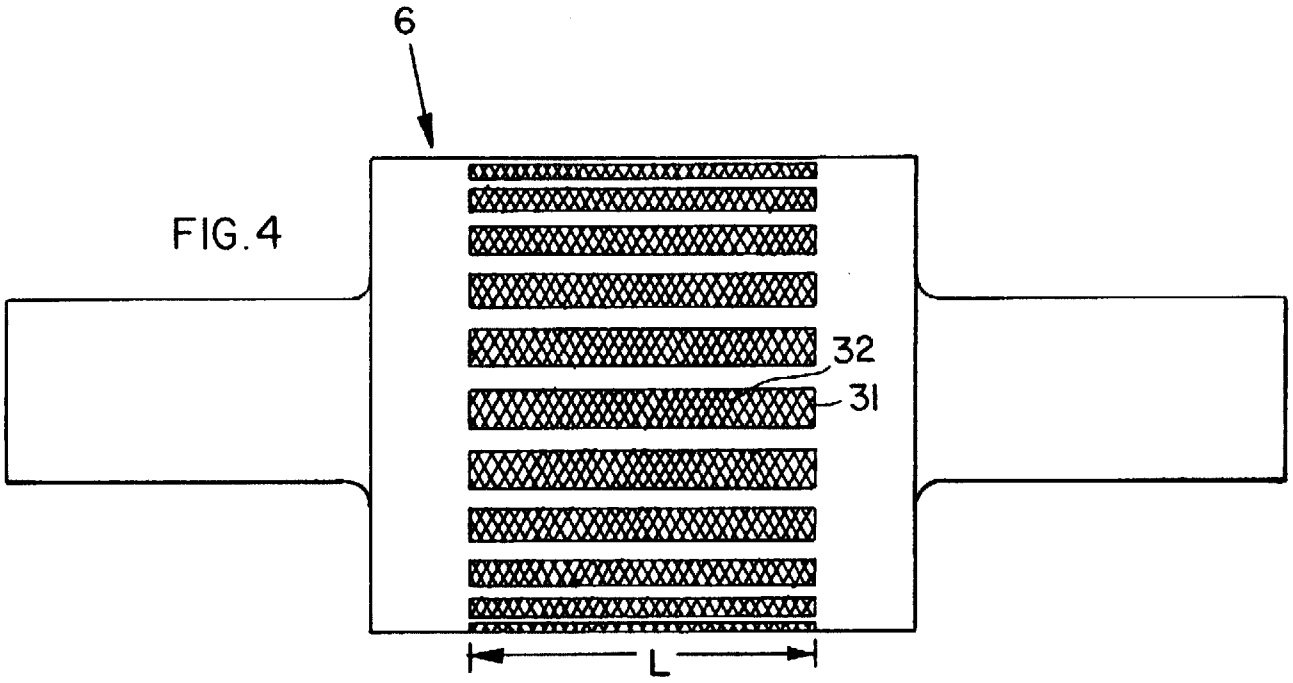
FIG. 4 is a plan view of an adhesive applicator roller having adhesive holding grooves in the manner of an intaglio printing roller.

FIG. 4 shows one embodiment of an applicator roller 6 constructed in the manner of an intaglio printing roller provided with raster shaped depressions 32 in the surface areas 31. These raster shaped depressions 32 have a length L that corresponds to the length of the adhesive stripes 3C. The surface areas 31 with the depressions 32 are spaced around the circumference of the roller 6, thereby also forming the spacings S between neighboring stripes 3C shown in FIGS. 3 and 6. The raster shaped depressions 32 are filled with adhesive as the roller 6 passes through the trough 5 and any excess adhesive is removed by the doctor blade device 7 so that the circumferential spaces between the depressions 32 are free of adhesive to form the spacings S also free of adhesive, and adhesive preferably pressure sensitive adhesive, is present only in the depressions 32 for application to the anti-sticking surface of the web 15.

FIG. 5 shows a modified apparatus 1A according to the invention for applying adhesive to the web 15A coming from a supply roller 20A carried by a web roll-off mechanism 14A. The web 15A first travels over a guide roller 13A and then passes through the gap between two feed advance rollers 10A and 10B which feed the web or tape 15A to an applicator device 40 comprising an adhesive application nozzle 40A and a counter-roller 41A. The applicator device 40 holds a supply of a suitable adhesive. The nozzle 40A is preferably a slot nozzle, whereby the nozzle slot has a length corresponding to the length of the adhesive stripes 3C to be applied to the anti-stick surface of the web 15A. The nozzle 40A is operated intermittently for the application of a pattern of adhesive stripes 3C on the material web 15A with the spacing S free of adhesive between neighboring stripes 3C as shown in FIGS. 3 and 6.

The pulling roller pair 10A and 10B for the material web 15A is preferably arranged directly upstream of the nozzle 40A as viewed in the direction A of the travel of the web 15A. All other components of the embodiment of FIG. 5 are substantially the same as in FIGS. 1 and 2. Thus, the roller 21A carries a cutting edge 22A that cooperates with a counter edge 23A for cutting strips 3A prior to transferring and applying a cut strip 3A to an envelope. A pair of pulling rollers 8A is provided directly upstream of the cutter and applicator mechanism 16A. The conveyor 33 for the envelopes also has rollers 26A extending substantially along a horizontal path of the conveyor while the rollers 25A extend along a rising path of the conveyor as viewed in the advance direction from right to left in FIG. 5. The rising path accommodates the positioning of the apparatus 1.

In both embodiments it is preferable that the adhesive stripes 3C are spaced by a spacing S from one another in the longitudinal direction of the web 15, 15A and also from at least one, preferably two edges 43 of the web 15, 15A so as to form at least one margin 44 which facilitates peeling the backing off the stripes 3C once these strips have been bonded to the surface 2A of a closure flap of an envelope 2.

FIG. 6 is a view similar to that of FIG. 3. In FIG. 3 the individual envelopes 2 have already been severed from each other prior to the application of the strips 3 to the surfaces 2A. In FIG. 6 the envelopes 2C are still interconnected to form a continuous semi-finished product. However, the application of the strips 3A to the envelopes is the same in both instances. The severing of the individual envelopes is then achieved conventionally downstream of the roller 21 in FIG. 6.

FIGS. 3 and 6 show that the adhesive stripes 3C extend perpendicularly to the length of the web 15 on the anti-stick surface of the web 15 parallel to each other and to the surface of the web 15 as well as crosswise to the surface of the web 15.

In both embodiments the operation of the apparatus 1 and the feed advance of envelopes through the machine 27 are synchronized so that at least one severed strip 3B is secured to each article 2, and so that the knife edge 22, 22A of the roller 21, 21A cuts through the spacing S free of adhesive as shown in FIGS. 3 and 6.

Although the invention has been described with reference to specific example embodiments, it will be appreciated that it is intended to cover all modifications and equivalents within the scope of the appended claims.

What is claimed is:

1. A method for applying adhesive to a closure flap of envelopes comprising the following steps:

(a) feeding said envelopes on a conveyor (33) including a counter roller (24) in a feed advance direction (2B), whereby closure flaps of said envelopes are oriented substantially horizontally and crosswise to said feed advance direction;

(b) feeding a continuous flat, unfolded carrier web (15) having an anti-stick surface, through an adhesive applicator device (1, 1A);

(c) sequentially applying adhesive stripes (3C) to said anti-stick surface of said flat, unfolded carrier web (15) so that said adhesive stripes (3C) extend perpendicularly to and crosswise to a length of said web (15) on said anti-stick surface and so that a spacing (S) without adhesive is provided between each two neighboring adhesive stripes (3C) on said flat, unfolded carrier web (15);

(d) using a single cutter roller (21) also as a transfer roller for cooperation with said counter roller (24) in a transfer plane common to both rollers (21, 24);

(e) cutting said flat, unfolded carrier web (15) along and within said spacing (S) without adhesive with said single cutting roller (21) into individual adhesive carrying cover strips (3A), each strip having a carrier web backing and one of said adhesive stripes (3C) on said anti-stick surface; and (f) transferring and securing said cover strips (3A) with said single cutting roller (21) now operating as a transfer roller to said envelopes at said counter roller (24) so that a strip securing roller pressure is effective perpendicularly to a length of said cover strips (3A) and simultaneously along a length of said cover strips whereby one of said adhesive stripes (3C) is sandwiched between said backing formed by said flat, unfolded carrier web (15) and a surface of each closure flap, and so that said flat, unfolded carrier web (15) and said envelopes (2) can travel in vertical alignment with each other toward said transfer plane common to both rollers (21, 24).

2. The method of claim 1, comprising using as said flat, unfolded carrier web (15) a material that has an inherent anti-stick characteristic on said anti-stick surface.

3. The method of claim 1, comprising applying an anti-stick coating to a surface of said flat, unfolded carrier web (15) to form said anti-stick surface prior to said sequential applying of said adhesive stripes (3C).

4. The method of claim 1, wherein said adhesive stripes (3C) comprise a pressure sensitive adhesive on said anti-stick surface of said carrier web (15).

5. The method of claim 1, wherein a tape of silicone paper is used as said flat, unfolded carrier web (15), said silicone paper having an anti-stick characteristic to form said anti-stick surface.

6. The method of claim 1, wherein said cutting step is performed substantially centrally along said spacing (S) without adhesive between said two neighboring adhesive stripes (3C).

7. The method of claim 1, wherein said step of sequentially applying adhesive strides (3C) is performed so that a margin (44) without adhesive is formed at least along one edge of said flat, unfolded carrier web (15).

8. The method of claim 1, wherein said cutting step is performed by said single cutter and transfer roller (21) by severing said flat, unfolded carrier web (15) perpendicularly to a longitudinal edge (43) of said flat, unfolded carrier web (15), and wherein said securing step is performed by moving severed strips (3A) with said cutter and transfer roller (21) sequentially onto envelopes moving on said conveyor (33) in synchronism with said cutter and transfer roller (21) so that one cover strip (3A) carrying one adhesive stripe (3C) is secured to each closure flap (2B) of each envelope (2).

9. An apparatus for applying an adhesive to envelope closure flaps, comprising an adhesive applicator mechanism (1) including a supply device (14, 20) for supplying a flat, unfolded carrier web (15) having an anti-stick surface, rotatable adhesive applicator roller (6) and feed advance and guide rollers (8 to 13) for transporting said flat, unfolded carrier web (15) through said adhesive applicator mechanism (1) for applying adhesive stripes (3C) to said anti-stick surface of said flat, unfolded adhesive carrier web (15) by said adhesive applicator mechanism (1) so that said adhesive stripes (3C) extend on said anti-stick surface perpendicularly to a length of said carrier web (15) and crosswise to said anti-stick surface so that a spacing (S) without adhesive is provided between each two neighboring adhesive stripes (3C), a web cutting and strip applicator (16) arranged downstream of said adhesive applicator mechanism as viewed in a feed advance direction of said carrier web (15), said web cutting and strip applicator (16) comprising a combined web cutter and strip transfer roller (21) including a cutting knife (22) carried by said web cutter and strip transfer roller (21) and a counter member (23) positioned for cooperation with said cutting knife (22) on said roller (21) along said spacing (S) without adhesive thereby cutting said flat, unfolded carrier web (15) along and within each said spacing (S) without adhesive into cut strips (3A), each cut strip (3A) having one of said adhesive stripes (3C) at least on part of one surface of a strip (3A) forming a backing for said adhesive stripe (3C), said feed advance and guide rollers comprising a pair of feed and guide rollers (8) arranged opposite each other and directly upstream of said web cutter and strip transfer roller (21) for feeding said flat, unfolded carrier web onto said web cutter and strip transfer roller (21), said apparatus further comprising a roller conveyor (33) for transporting envelopes in a feed advance direction (2B, 33B), said roller conveyor (33) including a counter roller (24) positioned for cooperation with said web cutter and strip transfer roller (21) in a transfer plane common to both rollers (21, 24) for applying cut strips (3A) to said envelope closure flaps, said conveyor (33) comprising a first group of feed advance rollers (26) arranged upstream of said counter roller (24) and a second group of feed advance rollers (25) arranged downstream of said counter roller (24), said conveyor (33) and said feed advance and guide rollers (8 to 13) being arranged in vertical alignment with each other so that said envelopes (2) and said cut strips (3A) can travel into alignment with each other in said common transfer plane, whereby a transfer pressure applied by said rollers (21, 24) to said cut strips (3A) is effective perpendicularly to a length of said cut strips (3A) and simultaneously along said cut strips (3A), and wherein said feed advance and guide rollers comprise a guide and counter roller (10) for said adhesive applicator roller (6), a mounting bracket (17) journalled to said adhesive applicator mechanism (1) for a tilting movement of said mounting bracket, said guide and counter roller (10) being rotatably mounted to said mounting bracket (17), and a drive (18) connected to said mounting bracket (17) for pressing said guide and counter roller (10) against said adhesive applicator roller (6).

10. The apparatus of claim 9, wherein said adhesive applicator mechanism (1) further comprises an adhesive supply trough (5) for holding a supply of adhesive (4), said rotatable adhesive applicator roller (6) dipping into said supply trough (5), a doctor blade (7) arranged for screeding off excess adhesive from said applicator roller (6), and wherein said flat, unfolded carrier web (15) is looped around said guide and counter roller (10) positioned for cooperation with said adhesive applicator roller (6) to expose said flat, unfolded carrier web to adhesive carried by said applicator roller (6).

11. The apparatus of claim 10, wherein said feed advance and guide rollers are rotatably mounted on a plurality of rotational axes distributed around said trough (5) and around said adhesive applicator roller (6) so that said flat, unfolded carrier web (15) first travels from said supply device (20) downwardly on one side of said trough (5), then below said trough (5), then upwardly on the opposite side of said trough (5) and of said adhesive applicator roller (6), then around said counter roller (10) into contact with said adhesive applicator roller, and then away from said adhesive applicator roller (6) toward said web cutting device (16).

12. The apparatus of claim 9, wherein said drive (18) operates said mounting bracket and thus said guide and counter roller (10) in a pulsating manner for sequentially applying said adhesive stripes (3C) to said anti-stick surface of said flat, unfolded carrier web (15) whereby said spacing (S) is formed between each two neighboring adhesive stripes (3C) on said flat, unfolded carrier web (15).

13. The apparatus of claim 9, wherein said adhesive applicator roller (6) comprises depressions (32) arranged in a raster pattern in its roller surface, said raster pattern comprising a plurality of stripe surfaces (31) extending in parallel to each other on said roller surface and with a circumferential spacing from, each other substantially corresponding to said spacing (S), said raster pattern depressions holding adhesive in the manner of an intaglio printing roller, whereby said spacing (S) is formed between each two neighboring adhesive stripes (3C) on said flat unfolded carrier web (15).

14. An apparatus for applying an adhesive to envelope closure flaps, comprising a supply device (14A, 20A) for supplying a flat, unfolded carrier web (15A) having an anti-stick surface, an adhesive applicator mechanism (1A) including feed advance and guide rollers (8A, 10A, 10B, 13A) for applying adhesive stripes (3C) to said anti-stick surface of said flat, unfolded adhesive carrier web (15A) by said adhesive applicator mechanism (1A) so that said adhesive stripes (3C) extend on said anti-stick surface perpendicularly to a length of said carrier web (15) and crosswise to said anti-stick surface with a spacing (S) without adhesive between each two neighboring adhesive stripes (3C), a web cutting and applicator mechanism (16A) arranged downstream of said adhesive applicator mechanism (1A) as viewed in a feed advance direction of said carrier web (15A), said web cutting and applicator mechanism (16A) comprising a combined web cutter and strip transfer roller (21A) including a cutting knife (22A) carried by said web cutter and strip transfer roller (21A) and a counter member (23A) positioned for cooperation with said cutting knife (22A) on said roller (21A) along said spacing (S) without adhesive thereby cutting said flat, unfolded carrier web (15A) along and within each said spacing (S) without adhesive into cut strips (3A), each cut strip carrying one of said adhesive stripes (3C) at least on part of one surface of said cut strip forming a backing for said adhesive stripes (3C), said feed advance and guide rollers comprising a pair of feed and guide rollers (8A) arranged opposite each other and upstream of said web cutter and strip transfer roller (21A) for feeding said flat, unfolded carrier web (15A) onto said web cutter and strip transfer roller (21A), said apparatus further comprising a roller conveyor (33) for transporting envelopes in a feed advance direction (2B, 33B), said roller conveyor (33) including a counter roller (24A) positioned for cooperation with said web cutter and strip transfer roller (21A) in a transfer plane common to both rollers (21A, 24A) for applying cut strips (3A) to said envelope closure flaps, said roller conveyor (33) comprising a first group of feed advance rollers (26A) arranged upstream of said counter roller (24A) and a second group of feed advance rollers (25A) arranged downstream of said counter roller (24A), said roller conveyor (33) and said feed advance and guide rollers being arranged in vertical alignment with each other so that said envelopes (2) and said strips (3A) can travel into alignment with each other in said common transfer plane, wherein a transfer pressure applied by said rollers (21A, 24A) to said cut strips (3A) is effective perpendicularly to a length of said cut strips (3A) and simultaneously along said cut strips (3A), wherein said adhesive applicator mechanism (1A) comprises an adhesive spray nozzle (40, 40A) and a counter roller (41A) arranged opposite said adhesive spray nozzle (40, 40A) for presenting said carrier web (15A) to said adhesive spray nozzle for applying said adhesive stripes (3C) to said anti-stick surface of said carrier web (15A), said adhesive spray nozzle (40, 40A) having a slot with a slot length corresponding to a length of said adhesive stripes (3C), said nozzle slot length extending perpendicularly and crosswise to a length of said adhesive carrier web (15A) and parallel to said anti-stick surface of said adhesive carrier, web (15A) for applying said stripes (3C) to said carrier web (15A) with said spacings (S) without adhesive between each two neighboring adhesive stripes (3C).

15. The apparatus of claim 14, wherein said counter edge (23A) is positioned above said roller conveyor (33).

16. The apparatus of claim 15, wherein said counter edge (23A) and said counter roller (24A) are circumferentially spaced around said web cutter and strip transfer roller (21A).

* * * * *

UNITED STATES PATENT AND TRADEMARK OFFICE

CERTIFICATE OF CORRECTION

PATENT NO. : 5,776,285

DATED : Jul. 7, 1998

INVENTOR(S) : Blümle

It is certified that error appears in the above-identified patent and that said Letters Patent is hereby corrected as shown below:

page 2 of the Title Page, second column, line 2, replace "Matte et al." by --Mattei et al.--;

Col. 4, line 7, after "The" replace "cutter" by --cutting and strip applicator--, after "strip" (first occurrence) replace "cutting and strip applicator" by --cutter--.

Col. 8, line 10, after "adhesive" replace "strides" by --stripes--.

Col. 9, line 49, after "from" delete ",".

Signed and Sealed this

Sixth Day of October, 1998

*Attest:*

*Attesting Officer*

BRUCE LEHMAN

*Commissioner of Patents and Trademarks*